United States Patent [19]

Yanome

[11] Patent Number: 4,914,685

[45] Date of Patent: Apr. 3, 1990

[54] SPOT FILM DEVICE SUITABLE FOR USE WITH THE RADIOGRAPHIC SYSTEM

[75] Inventor: Masakatsu Yanome, Nishinasunomachi, Japan

[73] Assignee: Kabushiki Kaisha Toshiba, Kawasaki, Japan

[21] Appl. No.: 335,323

[22] Filed: Apr. 10, 1989

[30] Foreign Application Priority Data

Apr. 12, 1988 [JP] Japan ..... 63-90071

[51] Int. Cl.[4] ..... G21K 1/00

[52] U.S. Cl. ..... 378/155; 378/154; 378/176

[58] Field of Search ..... 378/154–155, 378/175, 181, 176

[56] References Cited

U.S. PATENT DOCUMENTS

| | | | |
|---|---|---|---|
| 2,132,774 | 10/1938 | Brown | 378/155 |
| 2,922,046 | 1/1960 | Billin | 378/155 |
| 3,710,106 | 1/1973 | Loncher et al. | 378/176 |
| 4,099,063 | 7/1978 | Pury et al. | 378/176 |
| 4,542,521 | 9/1985 | Hahn et al. | 378/154 |
| 4,731,806 | 3/1988 | Takahara | 378/154 |

*Primary Examiner*—Craig E. Church
*Assistant Examiner*—John C. Freeman
*Attorney, Agent, or Firm*—Finnegan, Henderson, Farabow, Garrett and Dunner

[57] ABSTRACT

A spot film device suitable for use with the radiographic system and having a device for carrying and oscillating a grid which serves to absorb X-rays scattered from an object to be radiographed. Rotation force generated by a motor is used not only to move the grid between radiographic and parking positions but also to oscillate the grid. This enables the grid carrier system to be made comparatively simple in construction. In addition, the grid is oscillated over a certain range by the rotation force transmitted from the motor, so that comparatively high reliability can be guaranteed in oscillating the grid.

10 Claims, 7 Drawing Sheets

SPOT FILM DEVICE SUITABLE FOR USE WITH THE RADIOGRAPHIC SYSTEM

BACKGROUND OF THE INVENTION

1. Field of the Invention

The present invention relates to a spot film device suitable for use with the radiographic system and having a grid for absorbing X-rays scattered from an object who is under radiographic process, and a grid carrier device for carrying or moving the grid between radiographic and parking positions.

2. Description of the Related Art

In the case of the spot film device for the radiographic system, object 2 to be examined is radiated with X-rays emitted from X-ray tube 1 and those X-rays penetrated through object 2 are transferred onto film 3 as an X-ray image of object 2, as shown in FIG. 1.

When object 2 is radiated with X-rays, X-ray scatter is caused from inside object 2 in addition to those effective X-ray components which include information on the X-ray image of object 2. When this X-ray scatter enters into film 3, film 3 is exposed to blur the X-ray image of object 2 on film 3. Grid 4 for absorbing this X-ray scatter is thus arranged above film 3. Grid 4 includes a plurality of lead foils 5 arranged side by side (or 40–60 lead foils per centimeter) and a plurality of interspacers 6 between these lead foils 5 through which X-rays can pass. Effective X-ray components are emitted in a certain direction, but X-rays scattered are emitted in various directions. When grid 4 is used, therefore, X-ray scattered can be absorbed by lead foils 5 and thus prevented from entering into film 3. This can prevent the X-ray image of object 2 from being blurred. On the other hand, effective X-ray components are allowed to pass through interspacers 6 to enter into film 3.

When the object is a pregnant lady or an infant, the amount of X-ray used is comparatively small. When the grid is used, however, effective X-ray components are more or less absorbed by the grid and the amount of effective X-ray components entering into the film becomes smaller not to display the X-ray image of the object on the film. Therefore, the grid is not used in this case. When the object is a grownup, the amount of X-ray used is comparatively large. Therefore, the grid is used.

When the grid is used, it happens sometimes that images (or shadows) of lead foils are projected on the film to appear as a mesh pattern thereon. The grid is thus shaken to prevent the mesh pattern from being transferred onto the film. When bones of a human body is to be radiographed, however, it is said there is no trouble even if the mesh pattern is transferred onto the film. Therefore, the grid is used but not shaken in this case.

As apparent from the above, there are cases where (1) the grid in not used, (2) the grid is used and oscillated, and (3) the grid is used but not oscillated.

In order to meet all of these cases, therefore, the spot film device is provided with the grid carrier device for moving the grid between radiographic and parking positions as well as shaking the grid when it is at the radiographic position. The radiographic position represents where the grid is positioned when it is used and the parking position denotes where the grid is positioned when it is not used.

In the case of the conventional grid carrier device, the grid is supported on the grid support frame such that the grid can oscillate. In other words, the grid is supported by one ends of plate springs, and the other ends of the plate springs are connected to the grid support frame. The grid support frame is connected to an endless belt and when this belt is rotated, the grid support frame is moved or carried between the radiographic and parking positions. When the grid support frame has reached the radiographic position, an electromagnet attached to the frame is excited to draw an iron piece attached to the grid and then demagnetized to release the iron piece. The grid is thus freely oscillated by the plate spring.

However, the free oscillating of the plate spring is damped as time goes by. The oscillating of the grid is thus damped accordingly and sometimes stopped in the worst case. This means that the grid is not reliably shaken over a certain range. In short, the conventional grid carrier system has low reliability in oscillating the grid.

Further, the grid support frame is moved by one means and the grid is shaken by another means in the case of the conventional grid carrier system. Namely, one means is the belt and another means is the electromagnet different from the belt. This causes the conventional grid carrier system to be made comparatively complicated in construction.

SUMMARY OF THE INVENTION

The object of the present invention is to provide a spot film device suitable for use with the radiographic system and having a grid carrier system highly reliable in oscillating the grid and simple in construction.

According to the present invention, there is provided a spot film device suitable for use with the radiographic system and comprising a grid for absorbing X-ray scattered from an object to be examined when the object is radiographed and a grid carrier device for carrying the grid between radiographic and parking positions the grid carrier device including frame means for supporting the grid such that it can oscillate, guide rail means for supporting the frame means such that it can move between the radiographic and parking positions, a source for generating rotation force, carrying means for receiving the rotation force and for carrying the frame means between the radiographic and parking position, oscillating means for receiving the rotation force and for oscillating the grid when the frame means is stopped at the radiographic position, and transmitting means for transmitting the rotation force from the source to the carrying means when it carry the frame means between the radiographic and parking positions, and for stopping the transmission of the rotation force to the carrying means and transmitting from the source to the oscillating means when the frame means has reached the radiographic position, so that the frame means is stopped at radiographic position and the grid is oscillated.

According to the present invention, rotation force is transmitted from the rotation force generator means (or motor) to the carrying means to carry or move the frame means between the radiographic and parking positions. When the grid support means has reached the radiographic position, the transmission of the rotation force from the motor to the carrier means is stopped to hold the frame means at the radiographic position but the rotation force is transmitted from the motor to the oscillating means to oscillate the grid. This means that the rotation force generated by one motor is used to oscillate the grid as well as to move the grid between the radiographic and parking positions. The grid carrier device can be thus made comparatively simple in construction.

Further, the grid is oscillated by the rotation force of the motor. This means that the grid can be reliably oscillated over a certain range without damping its oscillating as often seen conventionally. Therefore, the grid carrier device of the present invention can have comparatively high reliability in oscillating the grid.

DETAILED DESCRIPTION OF THE PREFERRED EMBODIMENTS

FIGS. 3 through 6 show a spot film device suitable for use with the radiographic system and having a first example of the grid carrier device according to the present invention.

Figure 1:
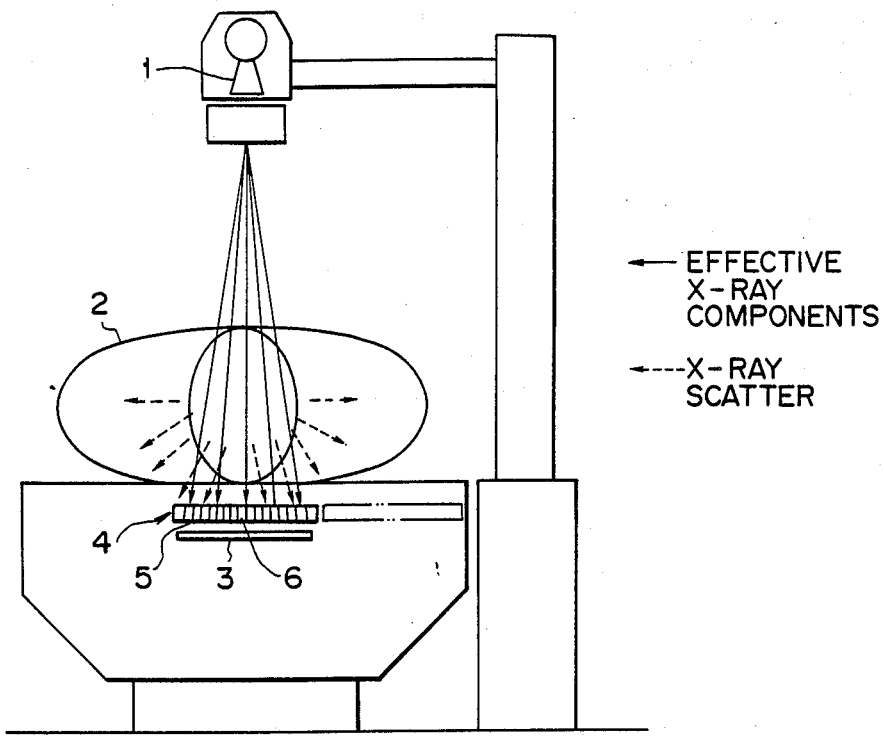
FIG. 1 shows a model of the spot film device for use with the radiographic system.
Figure 2:
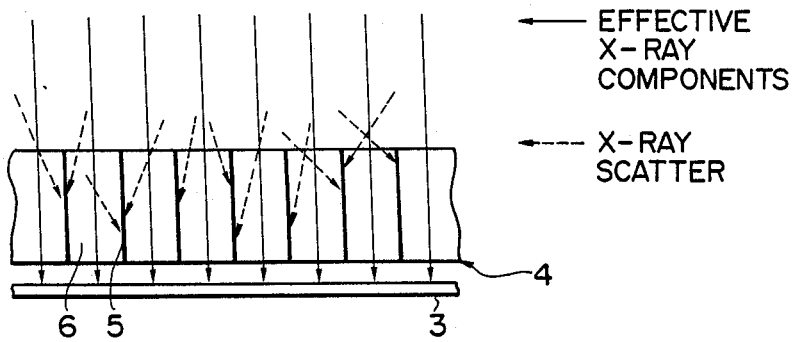
FIG. 2 is an enlarged view showing the grid.
Figure 3:
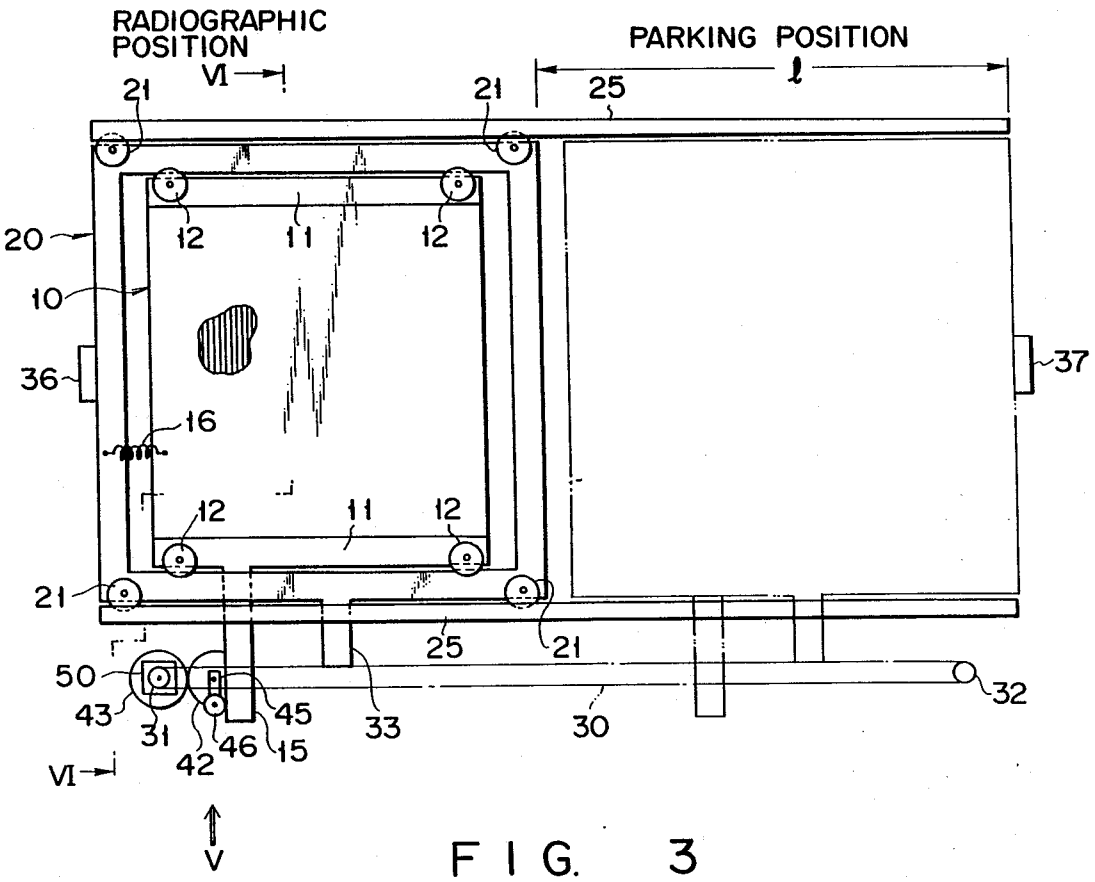
FIG. 3 is a plan showing a first example of the grid carrier device according to the present invention.
Figure 4:
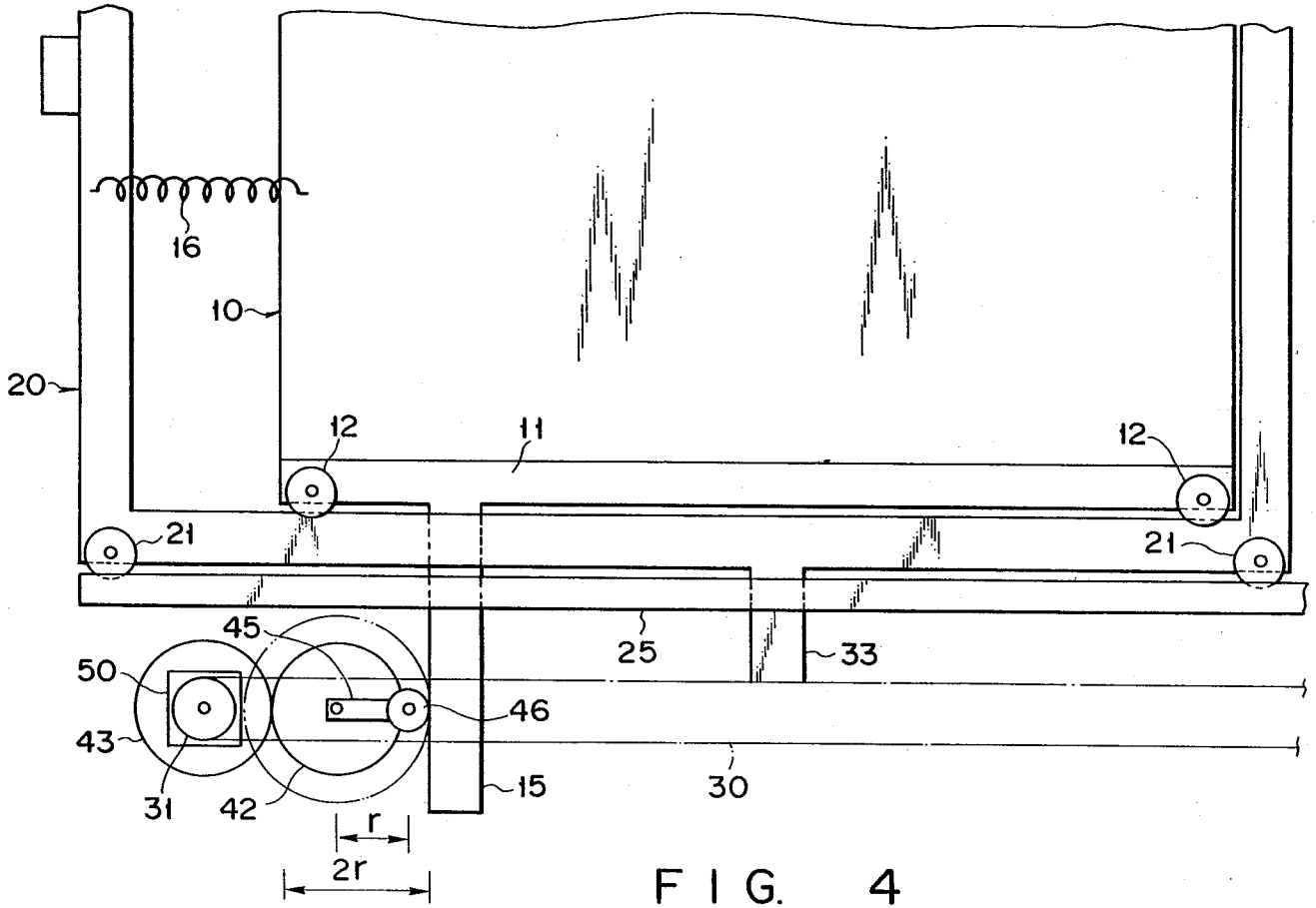
FIG. 4 is an enlarged plan showing the grid carrier device in FIG. 3.
Figure 6:
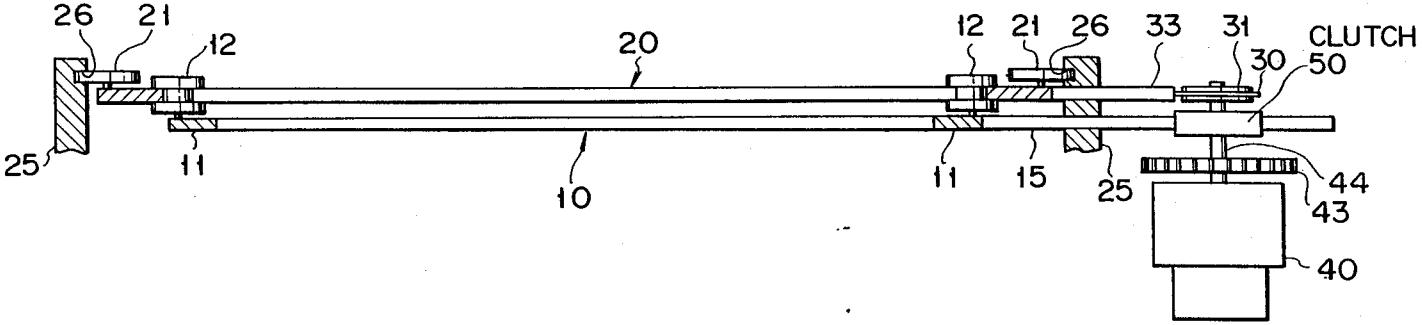
FIG. 6 is a sectional view taken along a line VI—VI in FIG. 3.

As shown in FIGS. 3 and 4, this grid carrier device has frame 20 for supporting grid 10. Four wheels 12 are rotatably attached to two holder members 11 for grid 10. These wheels 12 are slid along the inner rims of grid support frame 20, as shown in FIG. 6. Grid 10 is thus supported by frame 20 such that grid 10 can oscillate. Lever 15 extending from holder member 11 for grid 10 passes through guide rail 25. Grid 10 and lever 15 are urged left in FIG. 3 by spring 16.

Four wheels 21 is attached to grid support frame 20. These wheels 21 are slid along grooves 26 in guide rails 25, as shown in FIG. 6. Grid support frame 20 is thus supported movable between radiographic and parking positions by guide rails 25.

Endless belt or chain 30 is stretched between first toothed pulley 31 and second toothed pulley (or idlers) 32. Chain 30 is connected to grid support frame 20 by coupling member 33 which extends passing through guide rail 25. When pulley 31 and then chain 30 are rotated, therefore, grid support frame 20 is guided by guide rails 25 to move between the radiographic and parking positions. Stoppers 36 and 37 are located at the radiographic and parking positions, respectively, to limit the movement of grid support frame 20.

Figure 5:
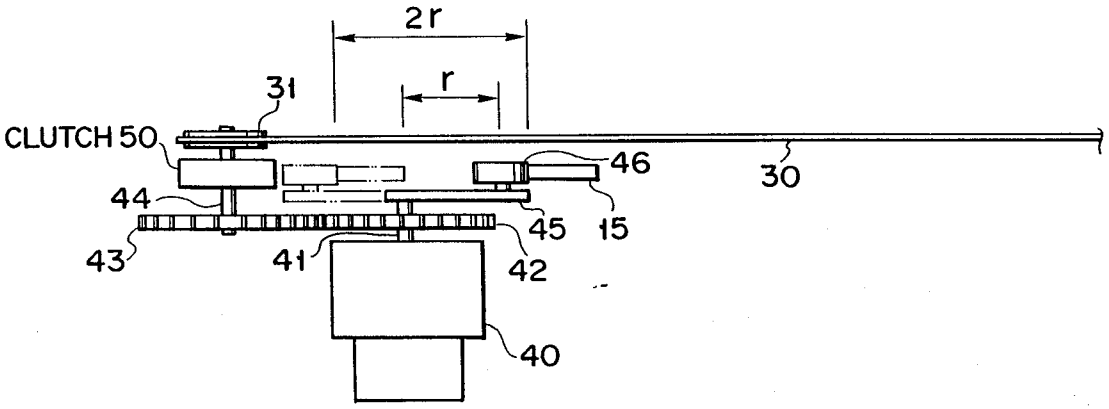
FIG. 5 is a view seen in a direction shown by V in FIG. 3.

Gear 42 is attached to output shaft 41 of motor 40, as shown in FIG. 5. Another gear 43 is engaged with gear 42. Friction clutch 50 is attached to shaft 44 fixed to gear 43. Pulley 31 is fixed to the top of shaft which extends upward from clutch 50. The rotation of motor 40 is thus transmitted to pulley 31 through gears 42, 43, shaft 44 and clutch 50, so that chain 30 can be rotated.

When load applied to friction clutch 50 is small, friction clutch 50 serves to transmit the rotation of gear 43 to pulley 31. When the load is larger, however, clutch 50 stops transmitting the rotation of motor 40 from gear 43 to pulley 31 because sliding is caused in clutch 50.

When grid support frame 20 is moved between the radiographic and parking positions, no large load is applied to clutch 50. Clutch 50 serves therefore to transmit the rotation of motor 40 to pulley 31. When grid support frame 20 reaches the radiographic position and its movement is limited by stopper 36, large load is applied to clutch 50. This Causes the rotation of motor 40 not to be transmitted to pulley 31. As the result, chain 30 is stopped and grid support frame 20 is stopped accordingly.

The base end of arm 45 is fixed to the top of output shaft 41 of motor 40. Roller or bearing 46 is rotatably attached to the front end of arm 45. When grid support frame 20 is at the radiographic position, lever 15 of grid 10 which is urged by spring 16 is contacted with roller 46. When arm 45 is rotated at same speed as shown in FIG. 4, therefore, roller 46 is revolved round shaft 41 of motor 40, keeping lever 15 contacted therewith and drawing a circle whose radius is (r). More specifically, lever 15 moves following roller 46 because of the urging force of spring 16 when roller 46 is revolved in the left direction in FIG. 4. When roller 46 is revolved in the right direction in FIG. 4, however, lever 15 is pushed by roller 46 to move against the urging force of spring 16. Lever 15 is thus reciprocated to oscillate grid 10 over a certain distance of (2r).

When grid support frame 20 is at the parking position and motor 40 is started, the rotation of this motor is transmitted to clutch 50. Because comparatively large load is not added to clutch 50 this time, the rotation of motor 40 is transmitted to pulley 31 through clutch 50. Chain 30 is thus rotated and grid support frame 20 is moved from the parking position to the radiographic position (only by distance l).

When grid support frame 20 reaches the radiographic position, it strikes against stopper 36 and its movement is thus stopped. This causes comparatively large load to be added to friction clutch 50. As the result, the rotation of motor 40 is not transmitted to pulley 31 and grid support frame 20 is thus stopped at its radiographic position.

When X-ray photographs are to be taken without oscillating the grid, it is detected by a sensor (not shown) that grid support frame 20 is at its radiographic position, and the motor is thus stopped, thereby causing the grid not to be oscillated.

When X-ray photographs are to be taken while oscillating the grid, motor 40 is kept operative. When grid support frame 20 is stopped at the radiographic position, lever 15 of grid 10 is urged by spring 16 to contact roller 46 of arm 45. When arm 45 is rotated at same speed, roller 46 is revolved round shaft 41 of motor 40, keeping lever 15 contacted with roller 46 and drawing a circle whose radius is (r). Lever 15 is thus reciprocated to oscillate grid 10 over the certain distance of (2r).

When motor 40 is reversely rotated after the radiographic process, grid support frame 20 is returned from the radiographic position to the parking position.

In the case of the first embodiment of the present invention, therefore, the rotation of motor 40 is transmitted to chain 30 to move grid support frame 20 between the radiographic and parking positions. When grid support frame 20 reaches the radiographic position, it is stopped there and grid 10 is then oscillated. In short, the rotation of motor 40 is used not only to move grid 10 or grid support frame 20 between the radiographic and parking positions but also to oscillate grid 10. This enables the grid carrier device to be made relatively simple in construction. Namely, the device can be smaller-sized and made lighter in weight.

Further, it is the rotation of motor 40 that the grid is oscillated by. Therefore, it will not happen that the oscillating of the grid is reduced becoming smaller and smaller. The grid continues to be reliably oscillated over a certain range. The grid carrier system has therefore a relatively high reliability in shaking the grid.

A second example of the grid carrier device according to the present invention will be described, but description will be made only to those points which are different from the first example.

Figure 7:
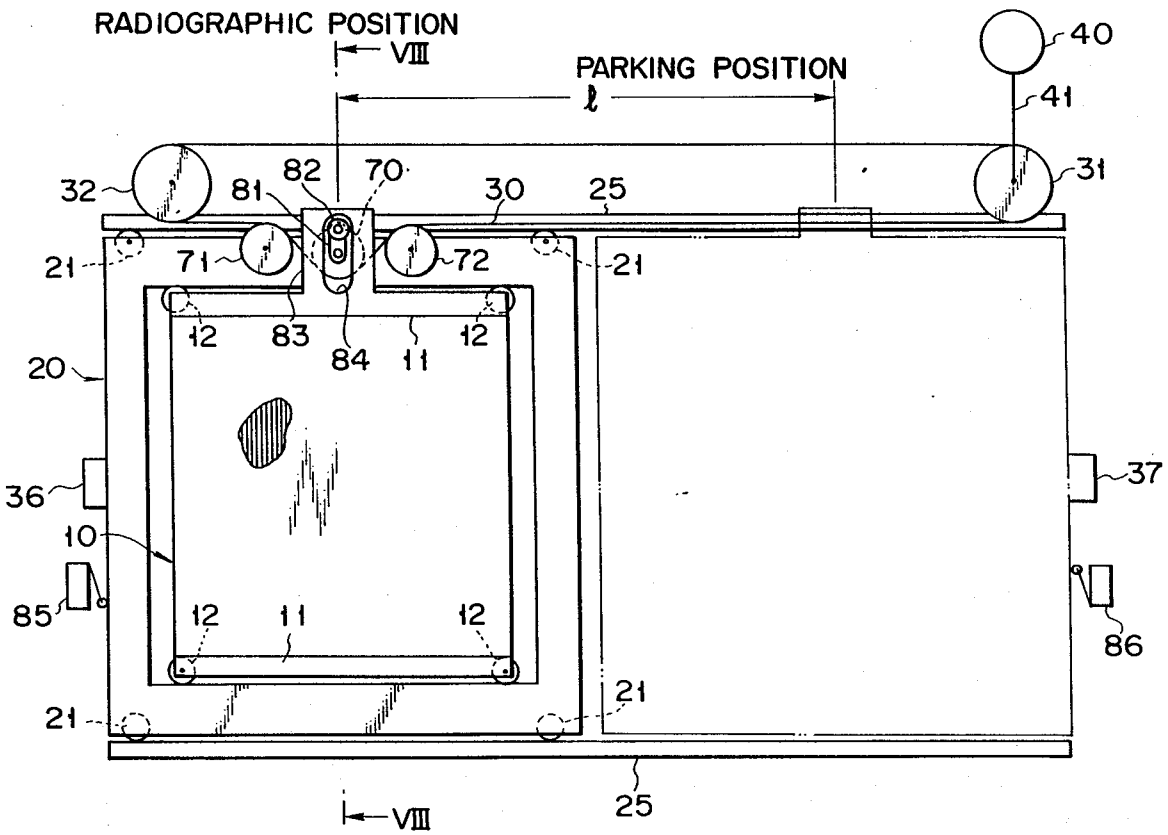
FIG. 7 is a plan showing a second example of the grid carrier device according to the present invention.
Figure 8:
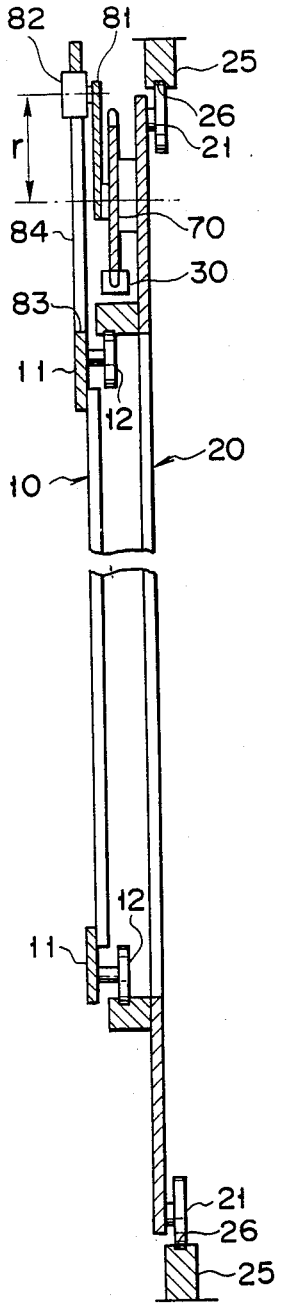
FIG. 8 is a sectional view taken along a line VIII—VIII in FIG. 7.

As shown in FIGS. 7 and 8, third toothed pulley 70 is rotatably attached to grid support frame 20. Chain or belt 30 runs contacting this third pulley 70. Further, fourth and fifth pulleys or idlers 71 and 72 are rotatably attached to grid support frame 20, contacting chain 30. These third through fifth pulleys cooperate with one another to apply tension to that portion of chain 30 which runs contacting these pulleys.

This tension is set larger than frictional force caused between wheels 21 of the grid support frame and grooves 26 in the guide rails. When chain 30 is moved, therefore, third through fifth pulleys 70, 71 and 72 are moved along with chain 30 because the rotation of these pulleys is restricted or stopped. When chain 30 is moved, therefore, grid support frame 20 is moved between the radiographic and parking positions.

Further, this tension is set smaller than torque by which chain 30 is rotated. When grid support frame 20 strikes against stopper 36, it is stopped there and third through fifth pulleys 70, 71 and 72 are allowed t rotate relative to chain 30. Chain 30 moves while rotating these pulleys. As the result, grid support frame 20 is stopped at the radiographic position and the grid is then oscillated as will be described below.

The base end of arm 81 is fixed to the shaft of third pulley 70. Roller 82 is rotatably attached to the front end of arm 81. Projection 83 extending from holder member 11 for grid 10 is provided with slit 84. When third pulley 70 is rotated along with arm 81, therefore, roller 82 slides along the inner rim of slit 84, drawing a circle whose radius is (r). As the result, the revolution of roller 82 is converted to the reciprocation of projection 83, thereby causing grid 10 to be oscillated over the certain distance of (2r).

When motor 40 is started to move chain 30, third through fifth pulleys are moved together with chain 30 so that grid support frame 20 can be moved from its parking position to the radiographic position (only by distance l).

When grid support frame 20 reaches the radiographic position, it strikes against stopper 36 and it is thus stopped. It is detected by sensor 85 that grid support frame 20 has reached the radiographic position, and signal is outputted through sensor 85.

When X-ray photographs are to be taken without oscillating the grid, motor 40 is stopped at the time when the signal is detected. The grid is not oscillated accordingly.

When the grid is to be oscillated at the radiographic position, motor 40 continues to be driven even after the signal is detected. Chain 30 is thus left moving. As described above, third pulley 70 is rotated along with chain 30 in this case. As the result, grid support frame 20 is stopped at the radiographic position but arm 81 is rotated while roller 82 slides along the inner rim of slit 84. This enables the grid to be oscillated over the certain distance of (2r).

When radiographic process is finished, motor 40 is stopped and the oscillating of the grid is also stopped. When motor 40 is reversely rotated, grid support frame 20 is moved from the radiographic position to the parking position and it is detected by sensor 86 that grid support frame 20 has reached its parking position.

The rotation of motor 40 is also used, in this second example, not only to move grid 10 between the radiographic and parking positions but also to oscillate grid 10. This enables the grid carrier device to be made small in size and light in weight. In addition, the grid carrier device has comparatively high reliability in oscillating the grid because the grid is shaken by motor 40.

What is claimed is:

1. A spot film device suitable for use with a radiographic system and comprising a grid for absorbing X-ray scattered from an object to be examined when the object is radiographed and a grid carrier device for carrying the grid between a radiographic position, where the grid is located in an X-ray beam and a parking position, where the grid is located outside said X-ray beam, said grid carrier device including:

frame means for supporting the grid such that it can oscillate;

guide rail means for supporting said frame means such that it can move between the radiographic and parking positions;

a source for generating rotation force;

carrying means for receiving the rotation force and for carrying the frame means between the radiographic and parking position;

oscillating means for receiving the rotation force and for oscillating the grid when said frame means is stopped at the radiographic positions; and transmitting means for transmitting the rotation force from said source to said carrying means when it carries said frame means between the radiographic and parking positions, and for stopping the transmission of the rotation force to said carrying means and transmitting from said source to said oscillating means when said frame means has reached the radiographic position, so that said frame means is stopped at the radiographic position and the grid is oscillated.

2. A spot film device according to claim 1, wherein said carrying means includes:

a pair of pulleys one of which is rotated by the rotation force transmitted from said source;

an endless belt stretched between said pulleys; and a coupling member for coupling the endless belt to said frame means.

3. A spot film device according to claim 2, wherein said oscillating means includes:

a lever extending from the grid;

means for urging the grid and the lever in a direction;

an arm having tip and proximal ends and rotated around the proximal end by the rotation force transmitted from said source; and a roller rotatably attached to the tip end of the arm and revolved keeping contacted with the lever by the urging force of the urging means and drawing a circle whose radius is a certain value, so that the lever is reciprocated to oscillate the grid over a certain range.

4. A spot film device according to claim 3, wherein said transmitting means includes clutch means for transmitting the rotation force from said source to one pulley when said carrying means carry said frame means between the radiographic and parking positions, and for stopping the transmission of the rotation force to said carrying means when said frame means has reached the radiographic position.

5. A spot film device according to claim 4, wherein said transmitting means includes means for causing the lever to be contacted with the roller when said frame means has reached the radiographic position.

6. A spot film device according to claim 1, wherein said carrying means includes:

a pair of first and second pulleys one of which is rotated by the rotation force transmitted from said source; and an endless belt stretched between said pulleys.

7. A spot film device according to claim 6, wherein said transmitting means includes:

a third pulley rotatably attached to said frame means and contacted with the endless belt;

means for adding tension to the belt running on the third pulley to prevent the pulley from rotating relative to the belt when said frame means is carried between radiographic and parking positions, so that the third pulley and said frame means move together with the belt; and means for allowing the third pulley to rotate relative to the belt when the frame means has reached the radiographic position, so that the frame means is stopped at the radiographic position.

8. A spot film device according to claim 7, wherein said tension adding means includes a pair of fourth and fifth pulleys rotatably attached to said frame means and contacted with the belt, so that the third through fifth pulleys cooperate with one another to tension to the belt running among them.

9. A spot film device according to claim 7, wherein said transmitting means includes means for transmitting the rotation force from the third pulley to said oscillating means when the third pulley rotate relative to the belt.

10. A spot film device according to claim 9, wherein said oscillating means includes:

an arm having tip and proximal ends, fixed to the third pulley at the proximal end and rotated around the proximal end by the rotation force transmitted from the third pulley;

a roller rotatably attached to the tip end of the arm; and a projection extending from the grid and having a slit with which the roller is engaged, whereby when the arm is rotated around the proximal end by the rotating third pulley, the roller slides along the inner rim of the slit, drawing a circle whose radius is a certain value, so that the projection is reciprocated to oscillate the grid over a certain range.

* * * * *